US007267147B2

(12) United States Patent
Tiscione

(10) Patent No.: US 7,267,147 B2
(45) Date of Patent: Sep. 11, 2007

(54) HIGH-CAPACITY CARD HOLDER AND EJECTOR

(75) Inventor: James A. Tiscione, Tucson, AZ (US)

(73) Assignee: ACM Enterprises, Inc., Tucson, AZ (US)

( * ) Notice: Subject to any disclaimer, the term of this patent is extended or adjusted under 35 U.S.C. 154(b) by 335 days.

(21) Appl. No.: 10/820,689

(22) Filed: Apr. 8, 2004

(65) Prior Publication Data

US 2005/0224149 A1 Oct. 13, 2005

(51) Int. Cl.
*A45C 11/18* (2006.01)

(52) U.S. Cl. ..... 150/147; 206/39.4

(58) Field of Classification Search ..... 206/39.4, 206/39.5, 39.6; 150/147
See application file for complete search history.

(56) References Cited

U.S. PATENT DOCUMENTS

| | | | | |
|---|---|---|---|---|
| 2,640,347 | A | 6/1953 | Majeski | |
| 2,789,613 | A | 4/1957 | Corsaw | |
| 3,109,538 | A | 11/1963 | Boxer | |
| 3,354,678 | A | 11/1967 | Stifelman | |
| 4,697,698 | A | 10/1987 | Holdener | |
| 4,739,897 | A | 4/1988 | Butler | |
| 4,792,058 | A | 12/1988 | Parker | |
| 4,852,727 | A | 8/1989 | Oberle | |
| 4,881,150 | A * | 11/1989 | Oyamada | 361/814 |
| 4,887,739 | A | 12/1989 | Parker | |
| 5,484,063 | A | 1/1996 | Cuccio et al. | |
| 5,791,461 | A | 8/1998 | Tsuge | |
| 5,960,944 | A | 10/1999 | Plocher | |
| 6,089,289 | A | 7/2000 | Florjancic | |
| 6,648,038 | B2 * | 11/2003 | Vetter | 150/147 |

* cited by examiner

*Primary Examiner*—Tri M. Mai
(74) *Attorney, Agent, or Firm*—Quarles & Brady LLP; Gavin J. Milczarek-Desai

(57) ABSTRACT

A three-dimensional card case including a cavity surrounded by two sidewalls, a rear wall and an opening on the side opposite the rear wall. The cards are inserted into slots at the opening of the cavity until they flush with an ejector tab at the rear wall. Each ejector tab is aligned with a pair of cards, allowing both cards to be ejected by the tab mechanism through the actuation of buttons located on the exterior of the case.

16 Claims, 9 Drawing Sheets

58
78F
42
76
80
56
78A 74
72
28
68
62
68
78A
78B
78C
78D
78E
78F
66
A'
76
42
4
12
6
70
66

HIGH-CAPACITY CARD HOLDER AND EJECTOR

BACKGROUND OF THE INVENTION

1. Field of the Invention

This invention is related in general to pocket or purse organizers and, in particular, to a device that organizes, stores, and protects wallet-sized cards, such as those containing credit or identification information.

2. Description of the Related Art

Inside a typical wallet or purse, one is likely to find a half-dozen or more cards such as license, credit, check, ATM, and membership cards, amongst others. The usual dimensions of these cards is approximately 8.5 cm in length by 5.5 cm in width and 1 mm or less in thickness. The storing, organizing, and retrieving of wallet-size cards has led to a need for compact, yet efficient, holders.

Standard wallets or purses may contain pockets or inserts of clear plastic envelopes that serve to store or organize cards. However, such features are not ideal for several reasons. First, cards can be difficult to retrieve from, or place into, deep pockets or plastic envelopes. Second, the space available for individual cards frequently is filled to capacity, requiring the storage of a stack of multiple cards in a single pocket or envelope. Thus, retrieval of a particular card is hampered because all cards in a stack must be at least partially removed or displaced during sorting. Moreover, cards can fall out of a purse or wallet pocket, or be fumbled and dropped while one is sorting through a stack to find a particular card.

U.S. Pat. No. 4,697,698 entitled "Credit and Identification Card Holder," issued to Holdener, describes a case for storing wallet-size cards. Each card is located on its own sliding drawer that can be individually advanced and removed from the case. The sliding drawer holds a card in place through the use of stops disposed at the ends of the drawer. In this manner, a card is prevented from falling out.

However, the requirement for the sliding drawer parts of Holdener necessarily augments the thickness of the card holder. Such extra thickness is a problem, in that it is undesirable for a pocket-size card holder to have more bulk than is needed to store the cards. Accordingly, as highlighted in the last paragraph before the claims of the Holdener patent, the sliding drawer design can result in a card holder that is very awkward to handle if made to accommodate more than 6 cards. Moreover, if the required sliding drawer parts become lost or broken, holder's device would suffer from diminished capacity or be practically unusable.

U.S. Pat. No. 6,412,627 by Tiscione et al. discloses a three-dimensional case that contains an interior cavity defined by a top piece and a bottom piece connected by two side walls and a rear wall, with an opening at one end of the case. Cards are inserted through the opening into one of several parallel slots disposed in each side wall of the case until they are frictionally engaged and flush with an ejection tab assembly located at the rear wall of the case. This design allows a card to be individually displaced by a particular tab assembly, which is linked to an actuator button located on the exterior of the case.

While Tiscione's case is suitable for its intended purpose, it must either be made wider to accommodate a greater number of ejection tab assemblies that would be needed for more than six cards or much thicker to accommodate extra card capacity as is illustrated by the "back-to-back" embodiment shown in FIG. 7 of the patent.

Thus, there continues to be a need in the art for a card holder that stores, organizes, protects, and allows easy retrieval of a large number of individual cards in a more compactly-designed case, then has heretofore been known.

BRIEF SUMMARY OF THE INVENTION

The invention relates to a case for carrying wallet-size cards that includes a plurality of card-ejection tab assemblies designed to engage one or two cards instead of a single card. Preferably, a notch at the card-contacting end of each ejection tab assembly provides the means for selectively ejecting one or both cards in alignment therewith. Thus, a case that compactly and efficiently stores from one to twelve (or more) cards is provided.

The primary objective of this invention is to provide a card holder that stores and organizes wallet-sized cards as compactly as possible.

Another general objective is to simplify the card identification and retrieval process such that individual cards may be selected and ejected from a holder quickly and easily.

Another, more specific, goal of the invention is to provide a compact card holder that does not rely on the use of a sliding drawer mechanism in order to store and access cards inside the holder.

Still another objective is to provide a holder that securely keeps cards inside the holder so as to prevent their accidentally falling out.

Another objective is to efficiently store from one to twelve cards in single pocket-size device.

Still another objective is to provide a compact card holder that is inexpensively manufactured from commonly available components.

Therefore, according to these and other objectives, the invention generally provides an improved compact, portable case designed primarily for the storage, selection and ejection of twelve or more wallet-size cards, such as a driver's license or debit card.

More specifically, the invention provides a three-dimensional case that contains an interior cavity defined by a top piece and a bottom piece connected by two side walls and a rear wall, with an opening at one end of the case. Cards are inserted through the opening into one of several parallel slots disposed in each side wall of the case until they are frictionally engaged, preferably by resilient pads disposed on each side wall, and flush with an ejection tab assembly located at the rear wall of the case. Each ejection tab assembly features an end that is adapted to be in alignment with and to engage two cards. This design allows one or two cards to be displaced by a particular ejection tab assembly, which is linked to an actuator button located on the exterior of the case. Preferably, each button is labeled with two indicia to remind the user of the two possible slot locations and the identity of the card to be ejected.

Also preferably, the ejection tab assembly is actuated by pushing a spring-loaded button in the direction of the opening of the case. The button is connected to a an U-shaped tab aligned with the back edge of two cards. Thus, as the button is slid toward the opening, the end of the U-shaped tab pushes a first card forward, extending it out of the device approximately one-half inch so that it may be pulled out for use. If the button is slid further, a second card is also ejected. Upon releasing the button, the compacted spring returns the button to its original position.

As mentioned above, cards are kept from falling out of the case of the invention by virtue of frictional engagement with a resilient material. While the case itself may provide for such engagement, resilient pads disposed parallel to the side walls of the case and located near the rear wall are preferred. Obviously, however, the frictional engagement force provided by the invention should be less than the ejection force provided by the tab assemblies such that cards may be advanced from the case.

The case preferably includes a permanent or removable clip that slidably attaches to the case along a groove located in each sidewall. Moreover, the case of the invention may include one or more card-like accessories adapted to harbor or display a mirror, paper currency, photographs, a nail file or other items typically carried in a wallet or purse. Finally, a protective cover made of, for example, leather or vinyl may be used in conjunction with the invention.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS OF THE INVENTION

The invention generally relates to a card holder case that stores and protects standard wallet-sized cards until a user selects and ejects a particular card out of the holder by sliding an actuator button linked to a card-ejection tab. Because each ejection tab is aligned with the back of the two cards, a given number of buttons can be used to selectively eject twice as many cards.

As used herein, the term "wallet-size cards" is meant to include any card, such as license, credit, check, ATM, and membership cards, that are approximately 8.5 cm long by 5.5 cm wide and 1 mm or so in thickness. The invention may also utilize accessory cards adapted to provide general utility functions, such a reflective surface, a magnifying glass, displaying a photograph, or holding a nail file or paper currency. Of course, as would be obvious to one skilled in the art, the case of the invention may be made to dimensions that are suitable for carrying cards or card-like objects of other dimensions as well.

Figure 1A:
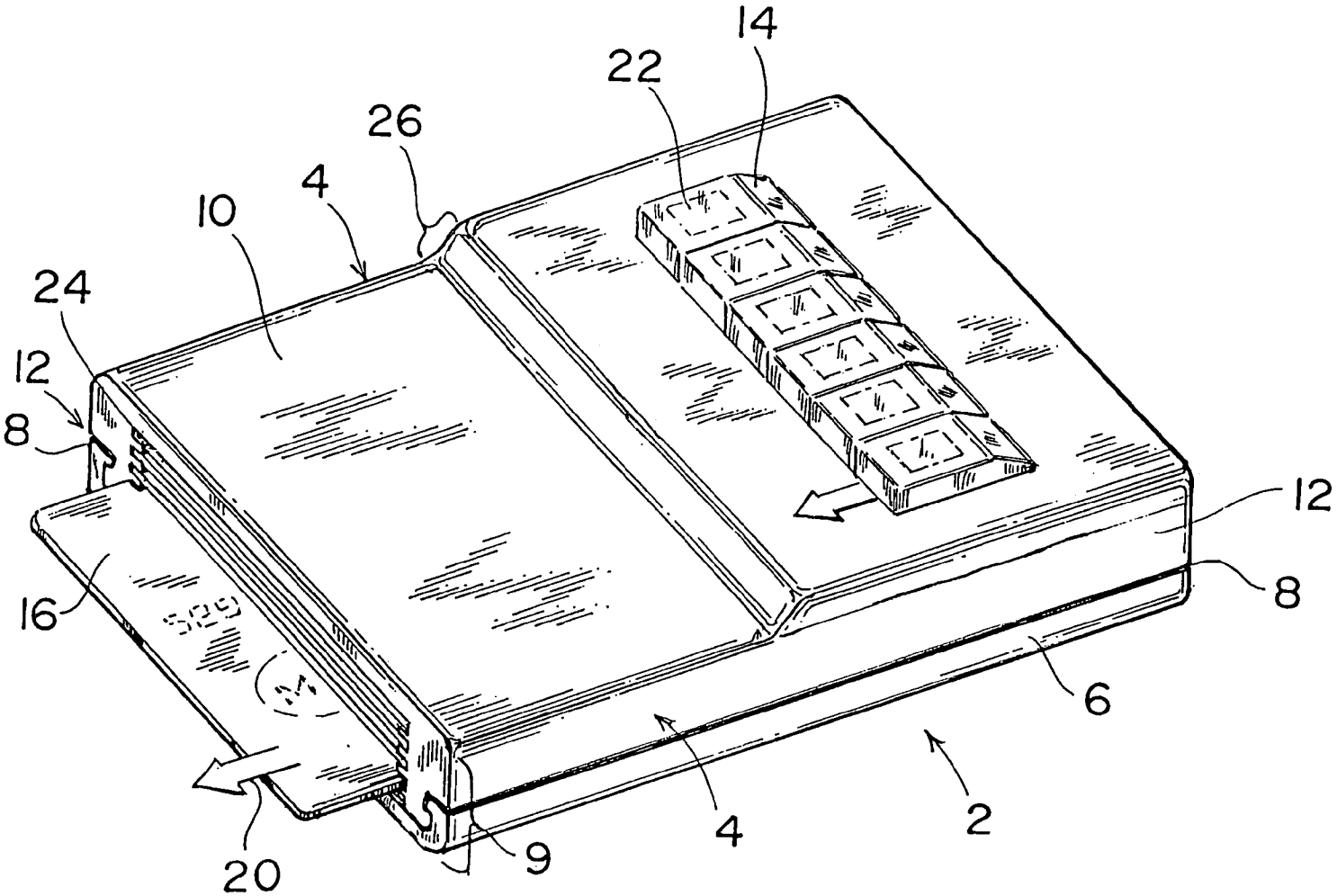
FIG. 1A illustrates schematically a perspective view of a preferred embodiment of the invention.

Referring to the drawings, wherein like parts are designated throughout with like numerals and symbols, FIG. 1A illustrates schematically a top perspective view of the preferred embodiment of the invention. In general, the body of case 2 includes a top piece 4 and a bottom piece 6 joined together at seam 8, an opening 9, and a rear wall attached to the back of top piece 4 (not shown in this view).

More specifically, the top piece 4 includes an top face 10 and a pair of side walls 12 in parallel connection with the top face 10. Disposed within cut-out sections (not shown) of the top face 10 are buttons 14. Each button 14 actuates the movement of a card 16 by sliding the button in the direction of arrow 18, resulting in the partial ejection of a card 18 in the direction of arrow 20. As shown, each button 14 preferably contains a label 22 identifying the card corresponding to a particular slot 24.

Preferably, the top piece 4 further includes a beveled region 26, which corresponds to an elevation of approximately one-quarter inch of the area of the top face 10, which provides space for the structure of the ejection tab assemblies (not shown) without interfering with card placement in slots 24. However, this design choice is not required for the operation of the invention.

Figure 1B:
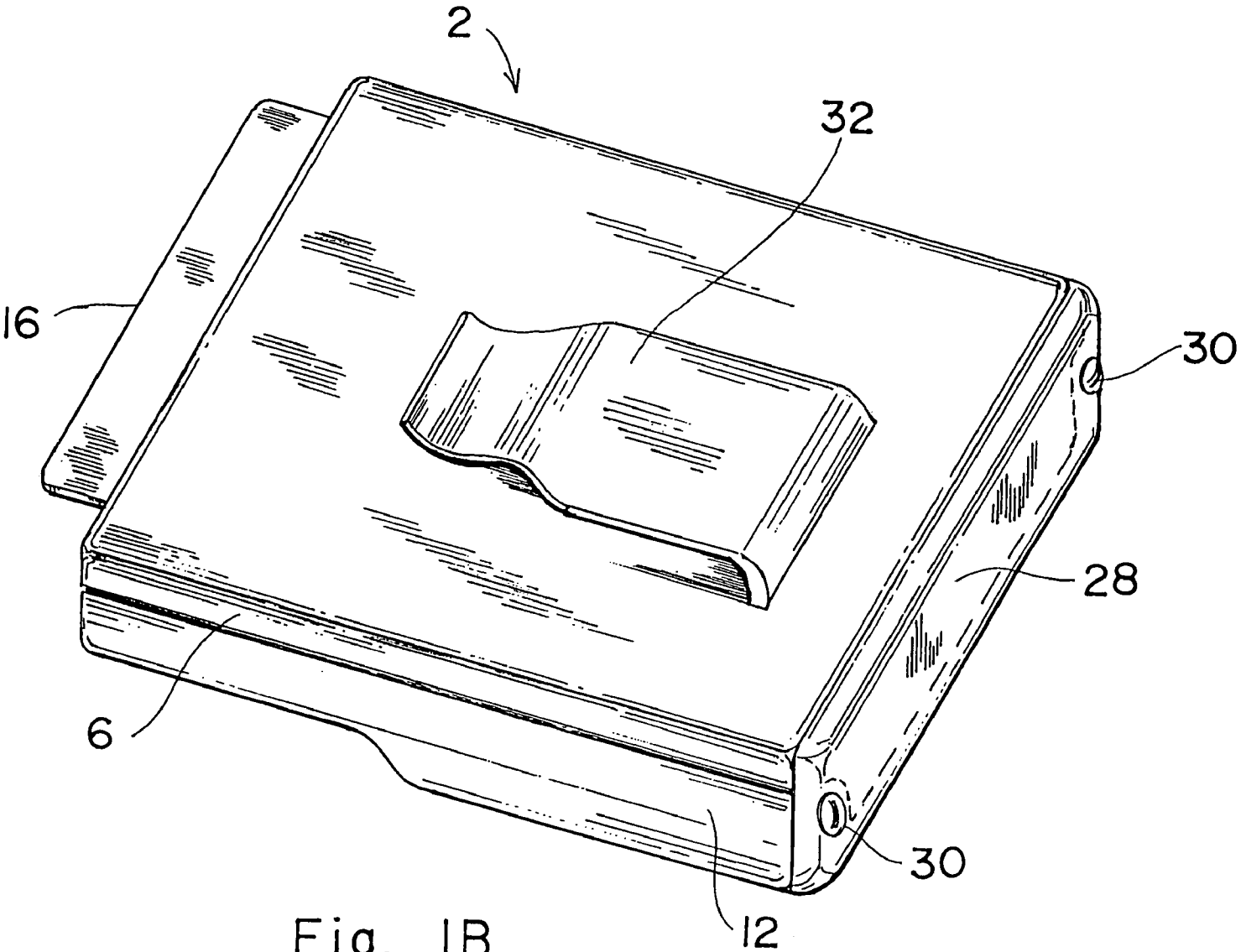
FIG. 1B schematically illustrates a perspective view of the bottom of the embodiment pictured in FIG. 1A.

FIG. 1B schematically illustrates a bottom perspective view of the preferred embodiment of the invention. In this view, rear wall 28 is apparent. Rear wall 28 is secured by screws 30 to each side wall 12 (to the area shown in phantom line). However, any other means for joining that is known in the art, such as through the use of adhesives or spot welds, may be used in place of screws 30. Clip 32 may be added as an optional accessory and used to hold paper currency or to secured the case 2 to the user by attachment to, for example, the user's clothing. If desired, clip 32 may be made removable by, for example, installing it with a screw.

Figure 2:
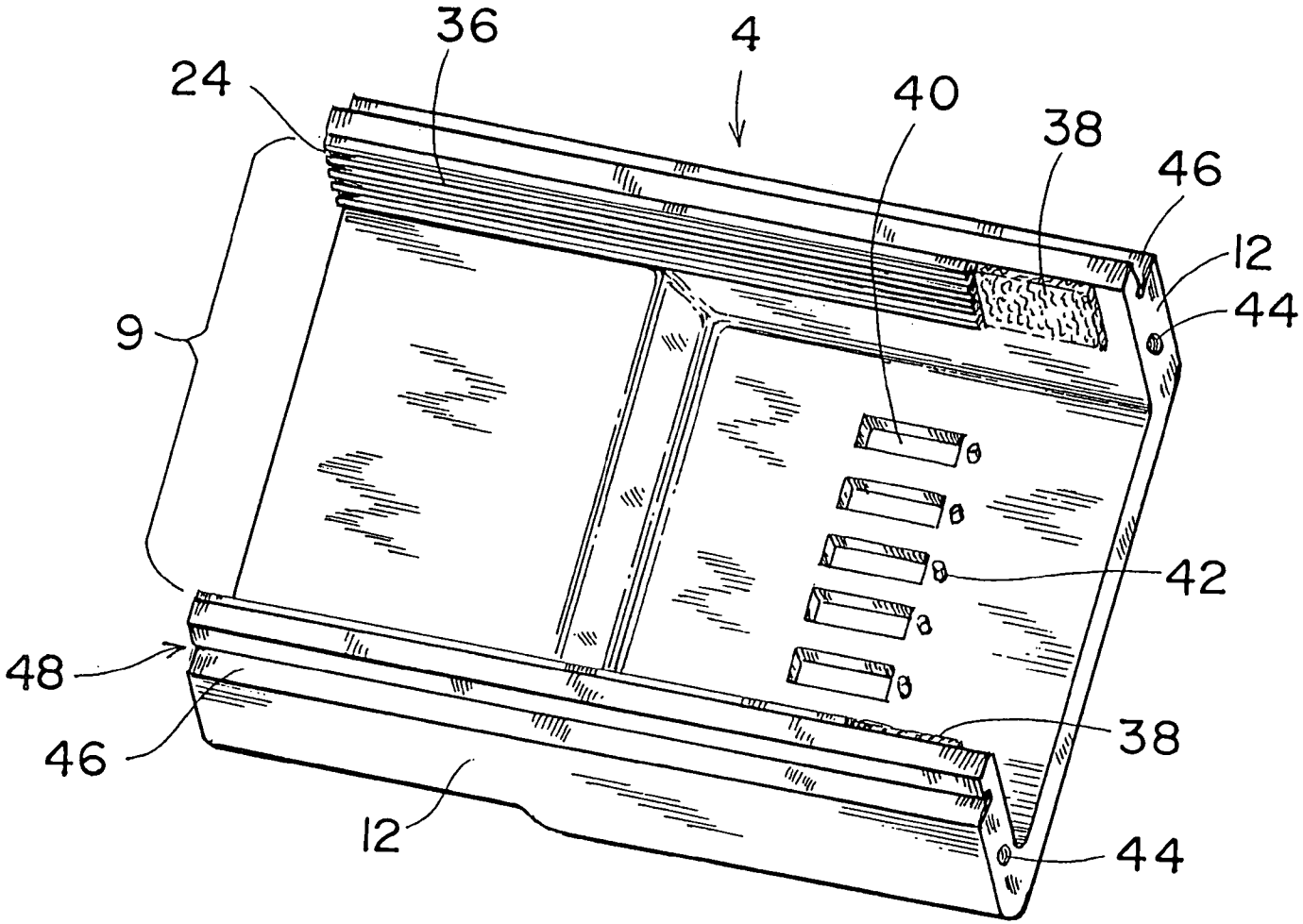
FIG. 2 illustrates schematically the top piece of the embodiment pictured in FIGS. 1A-1B. The top piece has been inverted for the purpose of showing and describing the structure on its interior.

FIG. 2 illustrates schematically the top piece of the preferred embodiment by itself, and has been inverted to better show detail on the inside. Six parallel slots 24 on each side wall 12 are formed by grooves 36, which are machined or otherwise formed into the side walls 12 of case 2. The slots 24 on each side wall 12 are arranged so as to be in planer alignment, such that up to six cards (not shown) may be stacked in parallel to one another. Toward the side opposite that of the opening 9, resilient pads 38 are adhered, or otherwise disposed, parallel to each side wall 12.

Pads 38 are generally less then a millimeter thick, extending no further then the width of the slots 24. Also, pads 38 are resilient such that they deform to frictionally engage a card placed into a slot 24. Because different cards can vary in thickness, the resiliency of the pads 38 is key in accommodating and securing a variety of cards in the slots 24. Hence, a card of practically any thickness is held completely inside the case 2 and will not fall out, even if the case is dropped. However, as would be obvious to one skilled in the art, the frictional holding force provided by the pads must be less then the force generated to displace a card.

The top piece 4 also includes a plurality of parallel cut-out sections 40. Cut-out sections 40 provide a space through which each ejection tab assembly (see FIG. 4) is disposed. Preferably, a spring located in a channel of each ejection tab assembly (see FIG. 4) is engaged by a rod 42 that protrudes from the interior of top piece 4 near the distal edge of each cut-out section 40. However, the invention does not require the use of spring-loaded ejection tab assemblies.

Several of the structural features of top piece 4 that enable assembly with the other components of the case 2 also are shown in FIG. 2. Holes 44 allow for the attachment of the rear wall (not shown) to the top piece 4. Furthermore, flat surface 46 and groove 48 on the exterior of each side wall 12 allow the bottom piece 6 of FIG. 3 to slidably engage the top piece 4, making assembly very straightforward.

Figure 3:
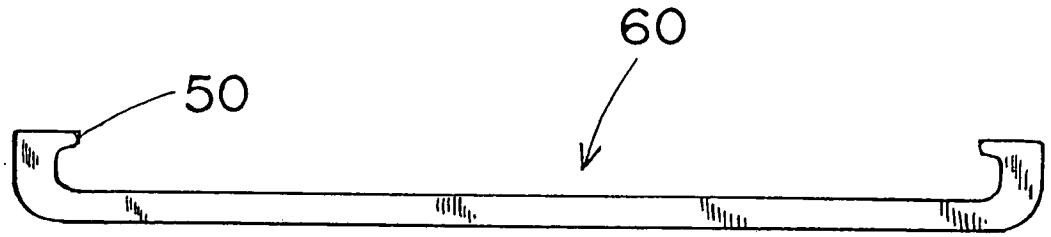
FIG. 3 illustrates schematically a front elevational view of the bottom piece of the embodiment illustrated in FIGS. 1A-1B

FIG. 3 illustrates schematically a front view of the bottom piece of the embodiment illustrated in FIGS. 1A-1B. Bottom piece 6 is essentially U-shaped, and includes a tongue 50 on each end of the U that slides into the grooves 48 of the side walls 12 during assembly.

Figure 4:
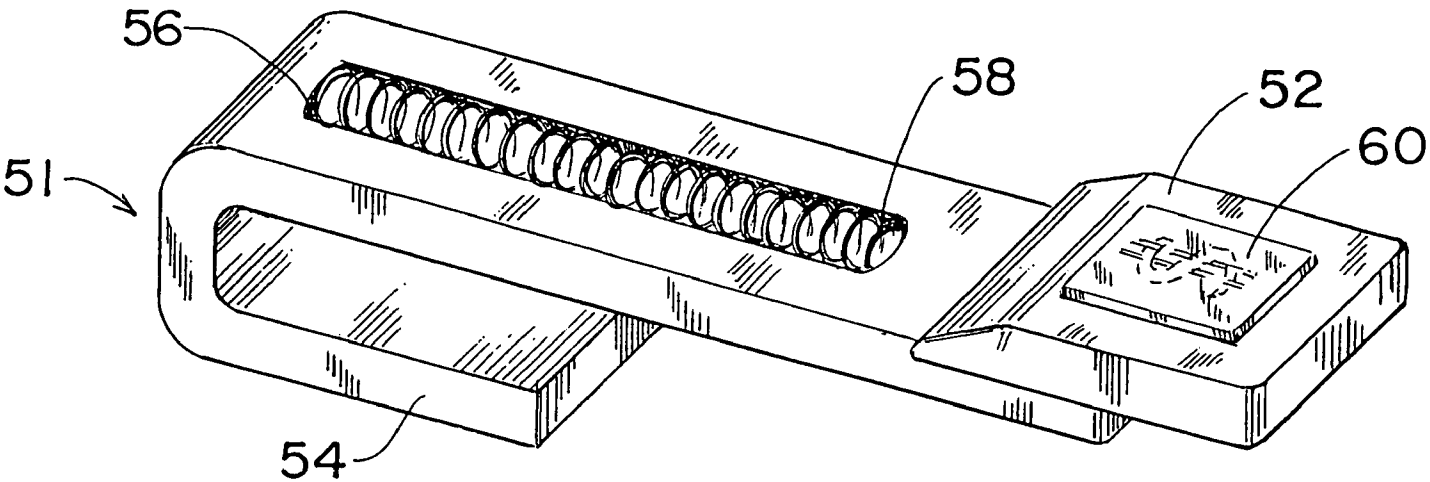
FIG. 4 illustrates schematically a magnified perspective view of the ejection tab assembly of a preferred embodiment.

FIG. 4 illustrates schematically a magnified perspective view of the ejection tab assembly 51 of the preferred embodiment. The assembly 51 includes a button 52 attached to an U-shaped tab 54. Each button 52 is made to be wider then the tab 54 it is attached to, so that the assembly 51 is held within a cut-out section 40 of top piece 4. In addition, each tab 54 is manufactured to be of a particular length such that it is in planar alignment with the position of a particular slot 24 (See FIGS. 6A-6B).

In the preferred ejection tab assembly, the assembly is spring-loaded. Hence, disposed within the top of tab 54 is a recess or channel 56. The channel 56 contains a spring 58, which engages a rod 42 of the top piece 4 (illustrated in FIG. 2) such that, when the assembly 51 is pushed in the direction of the case opening, the force provided by the compacting of spring 58 will return the assembly to its original position. An example of a label 60, which identifies the type of card that will be ejected by a particular assembly 51, is also shown.

Figure 5:
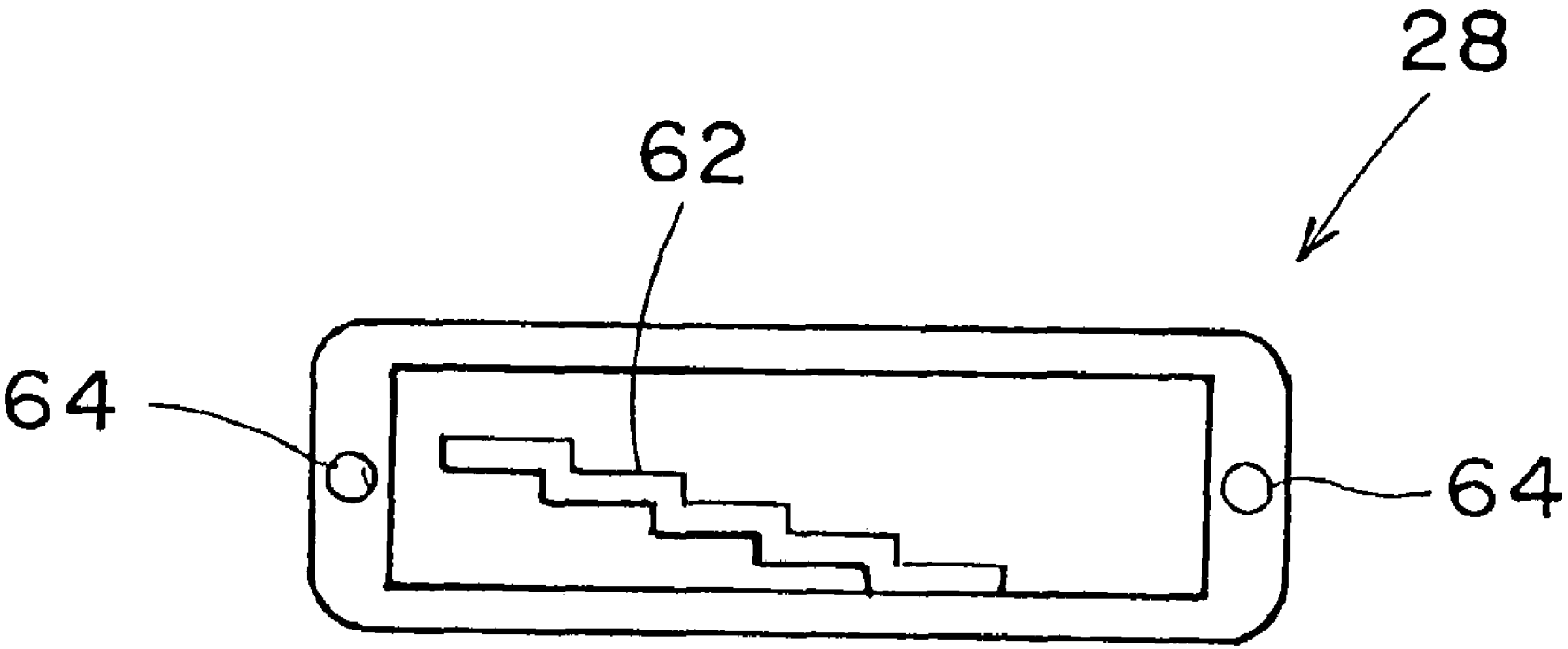
FIG. 5 illustrates schematically a front elevational view of the rear wall of the embodiment pictured in FIG. 1B.

FIG. 5 illustrates schematically a front view of the rear wall 28 of the preferred embodiment pictured in FIG. 1B. Preferably, the rear wall 28 contains a stabilizer bar 62. As shown, the stabilizer bar 62 is stepped in configuration. This stepped configuration helps keep each tab 54 in alignment at a particular slot's location such that operation of an ejection tab assembly remains unimpaired by ordinary wear and tear, such as when the case is dropped.

Figures 6A, 6B:
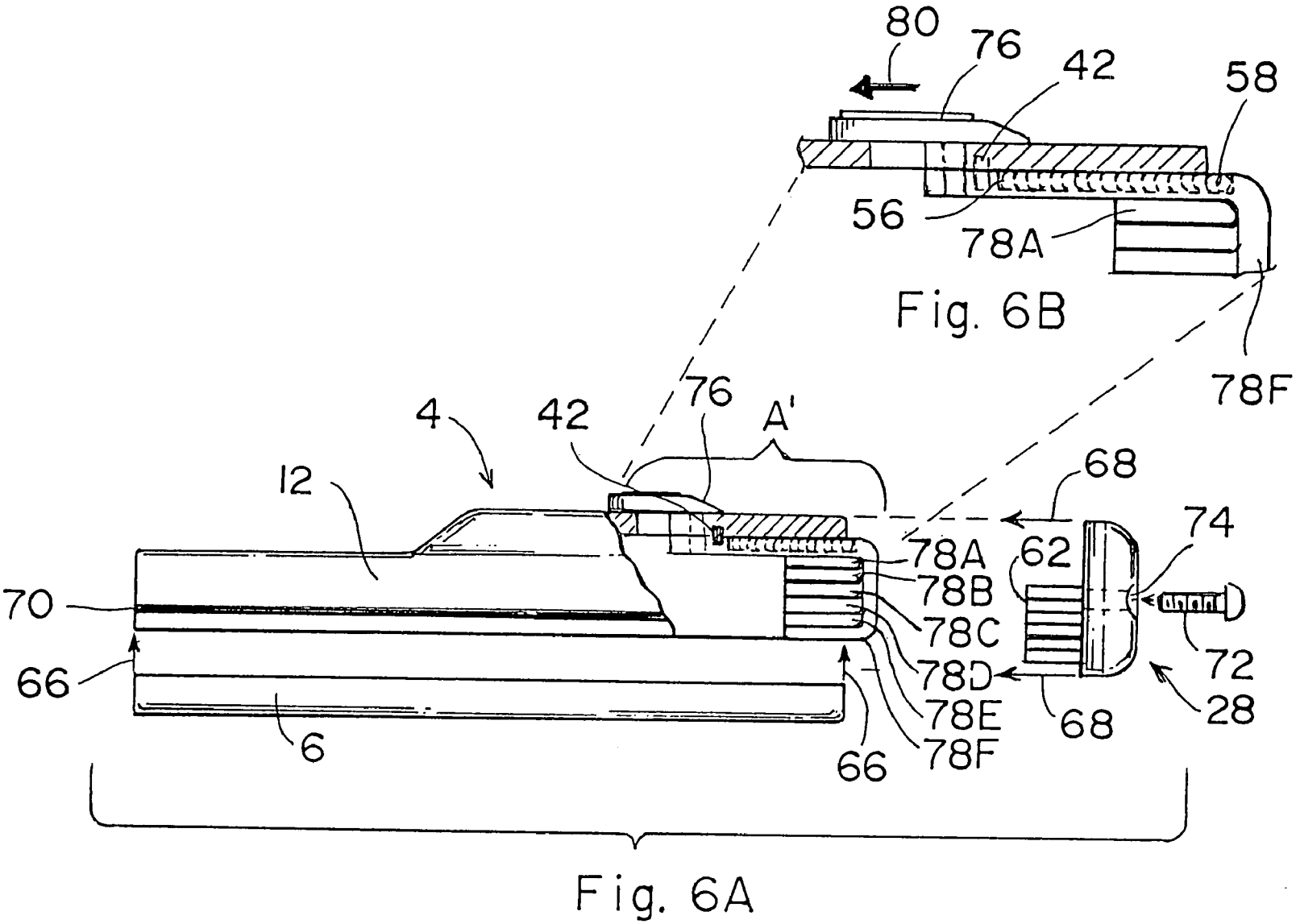
FIG. 6A illustrates schematically a partially-exploded side view of a preferred embodiment of the invention.
FIG. 6B illustrates schematically a magnified view of a portion of cut-away section A', showing the relationship between the spring of the preferred ejection tab assembly and a rod disposed on the top piece of the case.

FIG. 6A illustrates schematically a partially-exploded side view of the preferred embodiment of the invention. The invention is shown disassembled into its three main components, top piece 4, bottom piece 6 and rear wall 28. Arrows 66 and 68 roughly illustrate the order and orientation of the assembly process, i.e., the bottom piece 6 is slid onto the top piece 4 engaging groove 70, followed by the attachment of each end of the rear wall 28 to the top piece 4 via fasteners, such as screw 72 placed through hole 74. Additionally, as shown through cut-away section A' of side wall 12, a button 76 is connected to a tab 78A. Hence, the size and spatial arrangement of each U-shaped tab 78A-78F can be clearly discerned.

FIG. 6B illustrates schematically a magnified side view of cut-away section A'. As depicted, the rod 42 of the preferred embodiment is immersed inside the channel 56 (shown in phantom line) of U-shaped tab 78A, where it contacts spring 58 (shown in phantom line).

Figure 7:
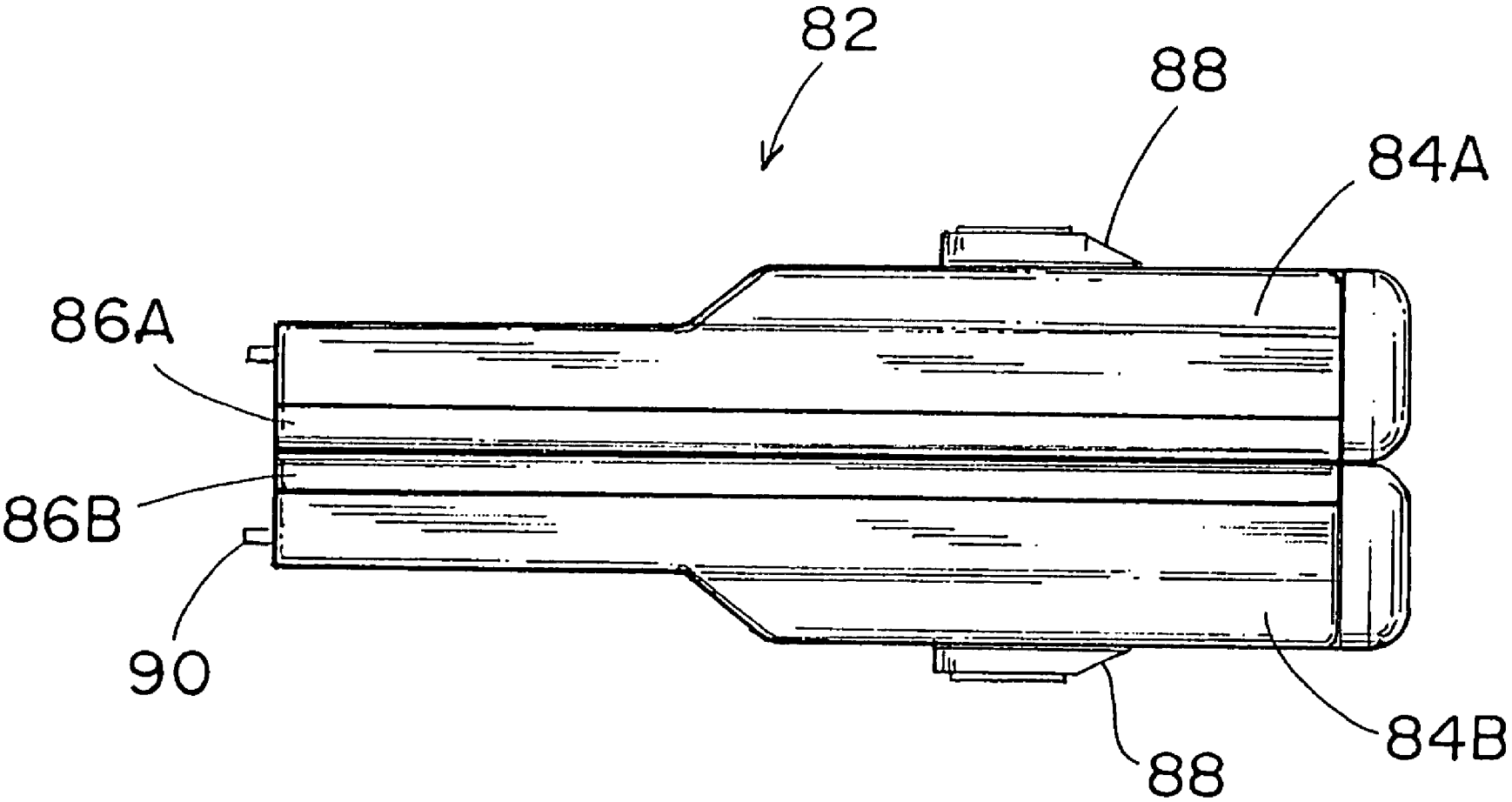
FIG. 7 illustrates schematically a high-capacity back-to-back embodiment of the invention.

FIG. 7 illustrates schematically an alternate embodiment of the invention. While the capacity of the illustrated preferred embodiment is shown to be six cards, the case of the invention can be manufactured in a "back-to-back" fashion so as to accommodate up to twelve cards. In other words, the twelve card holder 82 is can simply consist of two cases 84A and 84B that are joined by each bottom piece, 86A and 86B. Accordingly buttons 88 are disposed on each side of case 82 for ejection of a card 90.

Figure 8:
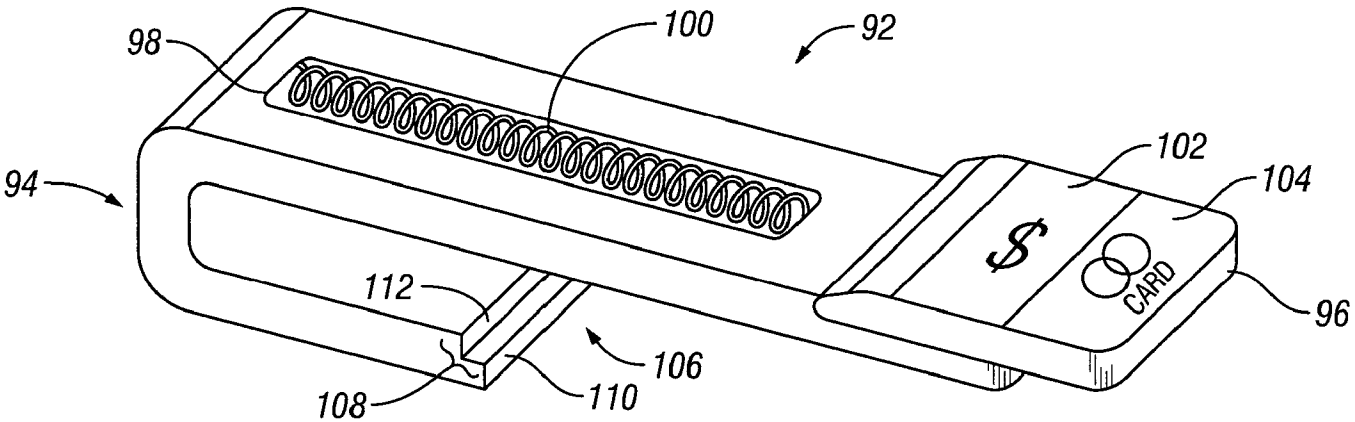
FIG. 8 schematically depicts in perspective view a second embodiment of ejection tab assembly of the invention FIG. 9 schematically illustrates in perspective view a high-capacity embodiment of the invention featuring the ejection tab assembly shown in FIG. 8.

Alternatively, a high capacity case may be provided by modifying the ejector tab assemblies of the invention as shown in FIG. 8. The ejection tab assembly 92 includes a U-shaped member 94 upon which button 96 is disposed. A recess 98 in the top of U-shaped member 94 houses a spring 100 that provides resilient tension to the assembly 92 as described above. Located on button 96 are two indicia, 102 and 104. Indicia 102 and 104 provide a means for identifying and selecting specific cards and may take many forms, such as adhesive labels or rubber tabs that fit into slots on the button surface. Thus, the indicia may be simply secured to the button according to a user's preferences and peeled or pried from the button surface for storage or use on a different button of the card holder.

While the end 106 of the U-shaped member 94 may be configured in many different ways to achieve the goal of engaging two cards, preferably, the end 106 of the U-shaped member 94 is adapted to engage one or two cards in alignment therewith through a longitudinally disposed notch 108 that effectively creates two card engaging surfaces, 110 and 112.

Figure 9:
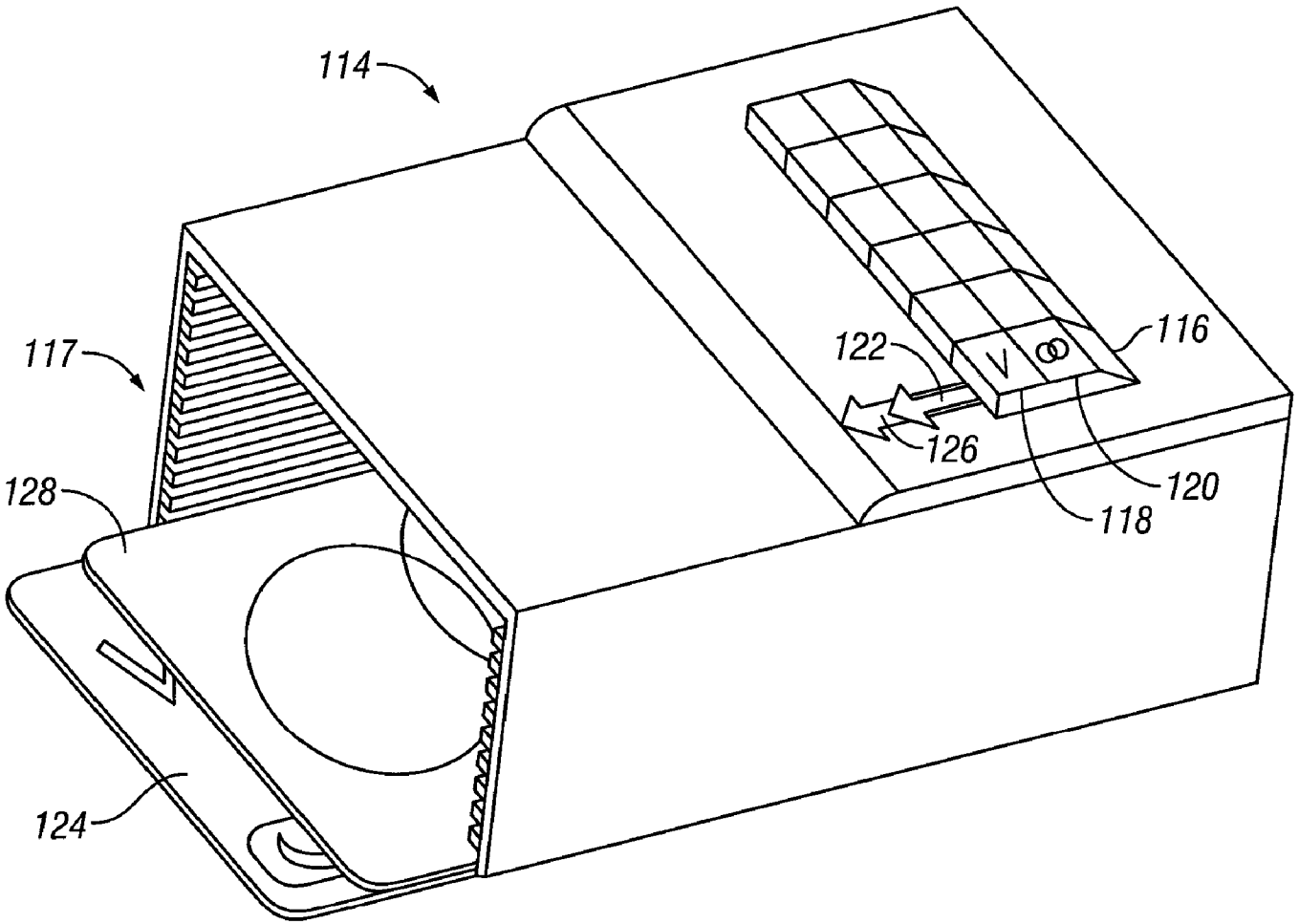

Turning to FIG. 9, a second high-capacity embodiment of the invention is shown. This high-capacity card holder 114 utilizes six of the modified ejection tab assembly shown in FIG. 8. When a user actuates button 116 by sliding it toward the opening 117 of the holder 114, the user may selectively eject either (or both) of the cards identified by indicia 118 and 120. Thus, sliding button 116 partially forward as indicated by arrow 122 ejects only the card identified by indicia 118 (i.e., card 124). This selective ejection occurs because only card 124 is contacted by card engaging surface 110 on the end 106 of U-shaped tab 94 (see FIG. 8). Alternately, if button 116 is slid forward more extensively as indicated by arrow 126, card 128 will be ejected in addition to card 124 because card 128 is contacted by card engaging surface 112 at the end 106 of U-shaped tab 94 (again, see FIG. 8). In this manner, six buttons may be used to selectively eject one of twelve cards, either alone or paired with another card, without the need to add excess thickness or width to holder 114 (e.g., by securing two card holders back-to-back as shown in FIG. 7 or by adding more buttons to the embodiment shown in FIG. 1).

Figure 10:
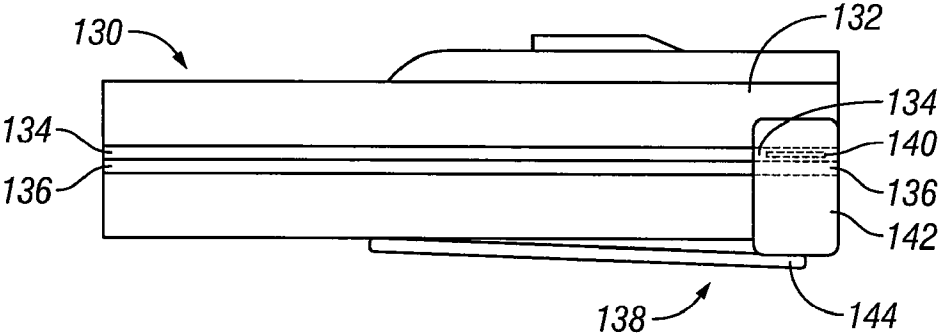
FIG. 10 schematically depicts in side elevational view a second embodiment of the clip component of the invention.

FIG. 10 illustrates another embodiment of the invention featuring a detachable clip. The card holder 130 has two sidewalls 132 (only one of which is shown in this view) within which grooves 134 and 136 are disposed. The clip 138 is secured to the holder 134 by slidable engagement of tab 140 into groove 134. Tab 140 is located on the interior of prong 142, which is attached to clip member 144. Note that the "tightness" of the clip 138 can be adjusted by engaging tab 140 in a different groove. So, for example, if a user desires to carry a large amount of paper currency, clip 138 may be attached to case 130 by engaging tab 140 into groove 136 (thereby providing more space between the clip member 144 and the bottom of case 130).

As would be recognized by one skilled in the art, the cases of the invention may be made of any moldable material, such as plastic, aluminum, stainless steel, or other metals.

Preferably, such materials of the cases are also resilient so as to frictionally engage cards placed inside.

Various changes in the details, steps and components that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and procedures.

I claim:

1. A holder for a plurality of wallet-sized cards, comprising:

a case, including a top piece and a bottom piece connected by two sidewalls and a rear wall, defining an interior cavity with an opening along an end of said case;

a plurality of parallel slots disposed within the side walls of the case, said slots being adapted to accommodate the wallet-size cards;

a plurality of parallel cut-out sections in the top piece of the case; and a plurality of ejection tab assemblies, each assembly being adapted for slidable movement toward said opening of the case and including a U-shaped member having an end adapted to engage and dispense at least two cards housed in said parallel slots in the direction of said opening, wherein a notch is disposed along said end of the U-shaped member, thereby forming two card engaging surfaces, and a button connected to said U-shaped member through one of said plurality of parallel cut-out sections.

2. The holder of claim 1, further comprising a resilient means for frictionally engaging the wallet-size cards within the case.

3. The holder of claim 2, wherein the means for frictionally engaging said cards comprises a resilient pad disposed on a side wall.

4. The holder of claim 2, wherein the means for frictionally engaging said cards comprises the plurality of parallel slots made from a resilient material.

5. The holder of claim 1, wherein said notch is disposed longitudinally across the end of the U-shaped member such that slidable engagement of said member to a first point ejects a first card from said case while further slidable engagement of said member ejects a second card from said case.

6. The holder of claim 1, wherein said button of an ejection tab assembly contains two indicia for identifying the contents of two of said parallel slots aligned with said ejection tab assembly.

7. The holder of claim 1, further including a clip mounted to the case through slidable engagement with a groove disposed upon each of said two sidewalls.

8. The holder of claim 7, wherein said clip is detachable.

9. A holder for a plurality of wallet-sized cards, comprising:

a case, including a top piece and a bottom piece connected by two sidewalls and a rear wall, defining an interior cavity with an opening along an end of said case;

a plurality of parallel slots disposed within the side walls of the case, said slots being adapted to accommodate the wallet-size cards in direct slidable arrangement within said slots;

a plurality of parallel cut-out sections in the top piece of the case; and a plurality of ejection tab assemblies, each assembly being adapted for slidable movement toward said opening of the case and including a U-shaped member having an end adapted to engage and dispense at least two cards housed in said parallel slots in the direction of said opening, wherein a notch is disposed along said end of the U-shaped member, thereby forming two card engaging surfaces, and a button connected to said U-shaped member through one of said plurality of parallel cut-out sections.

10. The holder of claim 9, further comprising a resilient means for frictionally engaging the wallet-size cards within the case.

11. The holder of claim 10, wherein the means for frictionally engaging said cards comprises the plurality of parallel slots made from a resilient material.

12. The holder of claim 10, wherein the means for frictionally engaging said cards comprises a resilient pad disposed on a side wall.

13. The holder of claim 9, wherein said notch is disposed longitudinally across the end of the U-shaped member such that slidable engagement of said member to a first point ejects a first card from said case while further slidable engagement of said member ejects a second card from said case.

14. The holder of claim 9, wherein said button of an ejection tab assembly contains two indicia for identifying the contents of two of said parallel slots aligned with said ejection tab assembly.

15. The holder of claim 9, further including a clip mounted to the case through slidable engagement with a groove disposed upon each of said two sidewalls.

16. The holder of claim 15, wherein said clip is detachable.

* * * * *